US007253403B2

(12) United States Patent
Reilly et al.

(10) Patent No.: US 7,253,403 B2
(45) Date of Patent: Aug. 7, 2007

(54) CONTROL SYSTEM FOR A POWER SUPPLY

(75) Inventors: James P. Reilly, Bloomington, IN (US); Noah P. Christian, Bloomington, IN (US)

(73) Assignee: Indiana University Research and Technology Corporation, Indianapolis, IN (US)

( * ) Notice: Subject to any disclaimer, the term of this patent is extended or adjusted under 35 U.S.C. 154(b) by 310 days.

(21) Appl. No.: 11/108,471

(22) Filed: Apr. 18, 2005

(65) Prior Publication Data

US 2005/0237035 A1 Oct. 27, 2005

Related U.S. Application Data

(60) Provisional application No. 60/647,367, filed on Jan. 25, 2005, provisional application No. 60/564,017, filed on Apr. 21, 2004.

(51) Int. Cl.
*G05F 1/70* (2006.01)

(52) U.S. Cl. ..... 250/281; 323/208

(58) Field of Classification Search ..... None
See application file for complete search history.

(56) References Cited

U.S. PATENT DOCUMENTS 6,225,930 B1 5/2001 Felps

FOREIGN PATENT DOCUMENTS

EP 0 707 209 A2 4/1996
EP 0 745 845 A2 12/1996
EP 1 182 453 A1 2/2002

OTHER PUBLICATIONS

Linear Technology, Application Note 86, "A Standards Lab Grade 20-Bit DAC with 0.1ppm/° C. Drift", Jan. 2001, 52 pgs.

*Primary Examiner*—Jack I. Berman
*Assistant Examiner*—Zia R. Hashmi
(74) *Attorney, Agent, or Firm*—Barnes & Thornburg LLP

(57) ABSTRACT

A control system (12) for a power supply (14), such as a high voltage power supply, includes a control circuit (16) and a feedback circuit (18, 28, 30). The feedback circuit (18, 28, 30) is configured to produce a feedback signal indicative of the voltage of the power supply output. The control circuit (16) is configured to control the power supply (14) based on the feedback signal and a predetermined voltage value to maintain the output of the power supply (14) at about the predetermined voltage value. A portion of the feedback circuit (18, 28, 30) may be included in an isolation shield (88) to improve the accuracy of the feedback signal.

30 Claims, 6 Drawing Sheets

CONTROL SYSTEM FOR A POWER SUPPLY

This patent application claims priority to and the benefit of U.S. Provisional Patent Application Ser. No. 60/564,017 entitled "Control System For A High Voltage Power Supply" which was filed Apr. 21, 2004 by James P. Reilly et al., the entirety of which is expressly incorporated herein by reference and U.S. Provisional Patent Application Ser. No. 60/647,367 entitled "High Voltage Power Supply Controller" which was filed on Jan. 25, 2005 by James P. Reilly et al., the entirety of which is expressly incorporated herein by reference.

BACKGROUND

The present disclosure relates generally to control systems, and more particularly, to control systems for power supplies.

Power supplies are used in numerous devices and applications as sources for voltage and/or current. In some devices, such as mass spectrometers, the accuracy of the voltage output of a power supply is a consideration in the overall performance of the device. Voltage drift and noise can adversely affect the accuracy of the voltage output. To improve accuracy, some power supplies require a "warm-up" period before the voltage output stabilizes to an operational value.

SUMMARY

The present invention comprises one or more of the features recited in the appended claims and/or the following features which, alone or in any combination, may comprise patentable subject matter:

According to one aspect, a control system for a power supply is disclosed. The power supply may be, for example, a high voltage power supply having an output voltage greater than about 1,000 volts. For example, the high voltage power supply may have an output voltage of about 30,000 volts. The power supply may be responsive to a power supply input signal to generate the output voltage. The control system may include a feedback circuit and a control circuit. The feedback circuit may be configured to receive the output voltage and produce a voltage reduction signal based thereon. The voltage reduction signal may have a voltage less than the output voltage of the power supply. The control circuit may be configured to receive the voltage reduction signal from the feedback circuit and control the power supply based on the voltage reduction signal and a predetermined voltage value. The predetermined voltage value may be provided to the control circuit via a user interface and/or a computer. The control circuit may control the power supply by, for example, producing the power supply input signal. The control circuit may use one or more of a number of control algorithms such as, for example, a proportional-integral-derivative control algorithm and/or a fuzzy logic control algorithm. For example, the control circuit may determine an average of the voltage reduction signal and produce a control signal based on the average and the predetermined voltage value. Additionally, the control circuit may be configured to determine the difference between the voltage reduction signal and the predetermined value and scale the control signal based on the difference. A portion of the feedback circuit may be positioned in an isolation shield to increase the accuracy of the feedback signal. The isolation shield may include, for example, an electrostatic shield and/or an environment-controlled housing. In addition, the control system may include a temperature compensating system coupled to a portion of the feedback signal to control the temperature of the portion. The feedback circuit may include a voltage reduction circuit and, in some embodiments, an analog-to-digital converter. The voltage reduction circuit may include a voltage divider circuit. The voltage divider circuit may be, for example, a resistive divider circuit and may have an impedance of about 100 giga-ohms. The control system may also include a converter configured to convert a digital control signal received from the control circuit to an analog power supply input signal. The converter may have sixteen or more data inputs and may be formed from one, two, or more two digital-to-analog converters.

According to another aspect, a method of controlling a power supply is disclosed. The power supply may be configured to produce an output voltage in response to a control signal. The method may include producing a voltage reduction signal based on the output voltage with a feedback circuit. The voltage reduction signal may have a voltage less than the output voltage. The method may also include determining the control signal based on the voltage reduction signal and a predetermined voltage value. The control signal may be determined by, for example, determining an average value of the voltage reduction signal and finding a difference between the average value and the predetermined value. The control signal may be adjusted based on the magnitude of the difference between the average value and the predetermined value. The method may further include shielding the feedback circuit from error-causing sources such as electrical noises and/or temperature variations.

According to a further aspect, a MALDI mass spectrometer system is disclosed. The system may include a MALDI mass spectrometer having a power input for receiving a power supply voltage. The system may also include a power supply configured to generate the power supply voltage in response to a control signal. The system may include a feedback circuit configured to receive the power supply voltage and produce a voltage reduction signal having a voltage less than the power supply voltage. The system may further include a control circuit configured to receive the voltage reduction signal and produce the control signal based on the voltage reduction signal and a predetermined voltage value. The system may also include a user interface and/or a computer to allow a user to supply the predetermined voltage value to the control circuit.

The above and other features of the present disclosure, which alone or in any combination may comprise patentable subject matter, will become apparent from the following description and the attached drawings.

BRIEF DESCRIPTION OF THE DRAWINGS

The detailed description particularly refers to the following figures, in which.

DETAILED DESCRIPTION OF THE DRAWINGS

Figure 1:
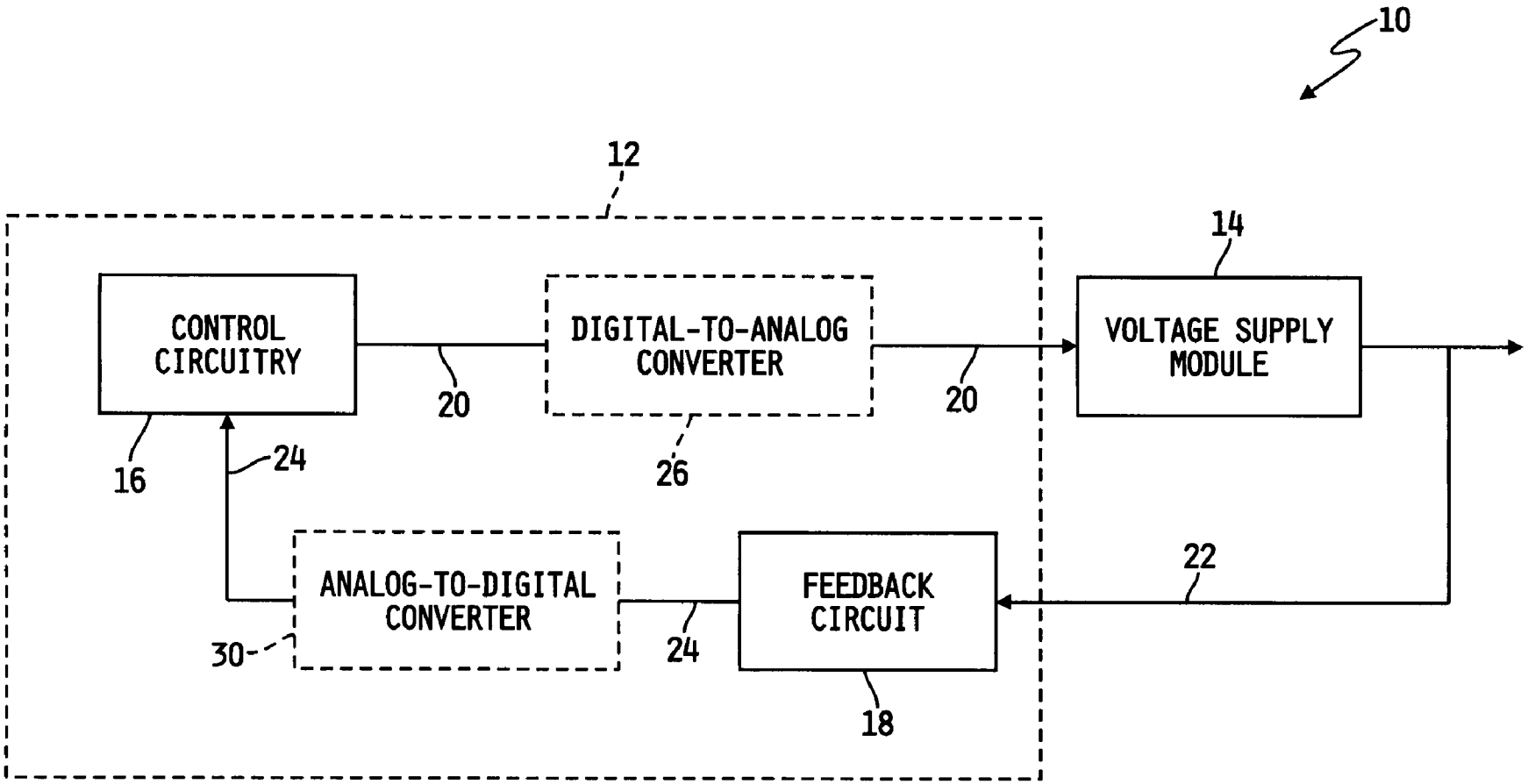
FIG. 1 is a simplified block diagram of a control system for controlling a power supply.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

Referring now to FIG. 1, a power supply system 10 includes a control system 12 and a voltage supply module 14. The system 12 includes a control circuit 16 and a feedback circuit 18. The data output terminal(s) of the control circuit 16 is coupled to the input terminal(s) of the voltage supply module 14 via a signal path 20. The input terminal of the feedback circuit 18 is coupled to the output terminal of the voltage supply module 14 via a signal path 22 and the output terminals of the feedback circuit 18 are coupled to the data input terminals of the control circuit 16 via a signal path 24. The signal paths 20, 22, and 24 may be any type of signal paths including, for example, wires, cables, printed circuit board traces, and the like. In addition, one or more of the signal paths 20, 22, and 24 may be a wireless connection and may use any type of communication technology and/or protocol to communicate data including, but not limited to, USB, TCP/IP, Bluetooth, ZigBee, Wi-Fi, Wireless USB, and the like. Further, although the signal paths 20, 22, 24 are illustrated in FIG. 1 as single interconnects, it should be appreciated that any one of the signal paths 20, 22, 24 may be embodied as a number of wires, cables, or other interconnects. For example, the signal path 24 may include sixteen, twenty, or twenty-four data wires connecting the feedback circuit 18 to the control circuit 16.

The control circuit 16 may be any type of control circuit including, but not limited to, a microcontroller, microprocessor, an application specific integrated circuit (ASIC), or any one or combination of general purpose control circuits operable as described herein. In the particular embodiment, the control circuit 16 may be embodied as an RCM 3000 commercially available from Rabbit Semiconductor of Davis, Calif. The voltage supply module 14 is a high voltage supply module configured to produce a voltage of greater than about 1,000 volts, such as 30,000 volts, based oh an input signal. In one particular embodiment, the voltage supply module is embodied as a CZE 30 PN123155 Voltage Module commercially available from Spellman High Voltage Electronics Corporation of Hauppauge, N.Y. The feedback circuit 18 may be any type of feedback circuit capable of converting the voltage output of the module 14 to a signal that is acceptable by the control circuit 16. For example, as discussed in more detail below in regards to FIG. 2, the feedback circuit may be configured to produce a feedback signal having a voltage less than the output voltage of the voltage supply module 14.

In some embodiments, the control circuit 16 may include therein a digital-to-analog converter such that the output of the control circuit 16 is an analog signal. Alternatively, an external digital-to-analog converter 26 may be included in the control system 12 and coupled to the control circuit 16 to convert digital outputs of the control circuit 16 to an analog signal. Additionally or alternatively, the control circuit 16 may include an analog-to-digital converter such that the control circuit 16 is capable of receiving analog input signals from the feedback circuit 18. Alternatively, an external analog-to-digital converter 30 may be included in the control system 12 and coupled to the control circuit 16 to convert an analog output of the feedback circuit 18 to digital input signals that are readable by the control circuit 16.

In operation, a predetermined voltage value is provided to the control circuit 16. The predetermined voltage value may be "hard-coded" into the firmware or software that is executed by the control circuit 16 or may be entered into the control circuit 16 using a user interface or computer as discussed in more detail below in regard to FIG. 2. The predetermined voltage value represents the desired voltage of the output signal of the module 14. For example, in one embodiment, the predetermined voltage value may be 30,000 volts. Based on the predetermined voltage value, the control circuit 16 generates a control signal that is transmitted to the module 14. The control signal may be a digital or an analog signal depending upon the application, the type of the control circuit 16, the components of the system 12, and/or the type of the module 14. For example, in embodiments wherein the control circuit 16 includes an internal digital-to-analog converter, the control circuit 16 may produce analog control signals that are acceptable by the voltage supply module 14. Alternatively, in embodiments wherein the control circuit 16 does not include an internal digital-to-analog converter, an analog-to-digital converter 26 may be included in the system 12 and configured to convert digital outputs of the control circuit 16 to an analog signal that is acceptable by the voltage supply module 14. Regardless, voltage supply module 14 generates an output voltage based on the control signal generated from the control circuit 16. That is, the output voltage of the module 14 is scaled according to the voltage of a signal presented at the input of the module 14. For example, in one embodiment, the voltage supply module 14 is configured to produce a voltage between and including 0 to 30,000 volts based on an input signal having a voltage between and including 0 and 10 volts.

The feedback circuit 18 receives the output signal from the voltage supply module 14 and produces a feedback signal that is readable by the control circuit 16. For example, in one embodiment, the feedback circuit 18 is configured to produce a feedback signal having a voltage less than the output voltage of the module 14. In embodiments wherein the control circuit 16 does not include an internal analog-to-digital converter, the feedback circuit 18 may include the analog-to-digital converter 30. For example, in one particular embodiment, the feedback circuit 18 is configured to reduce the voltage of the output signal of the module 14 to a voltage of about five volts or less and convert the reduced output signal to a digital feedback signal that the control circuit 16 is capable of reading. Regardless of whether the feedback signal is a digital or an analog signal, in response to the feedback signal, the control circuit 16 is configured to adjust the control signal based on the feedback signal and the predetermined value.

To do so, the control circuit 16 may use one or more of a number of control algorithms including, for example, simple linear control algorithms, proportional-integral-derivative control algorithms, fuzzy logic control algorithms, and the like. In one particular embodiment, the control circuit 16 is configured to determine the average of the feedback signal over a period of time and adjust the control signal based on the average of the feedback signal and the predetermined value. Additionally, the control circuit 16 may be configured to scale the control signal according to the difference between the predetermined value and the feedback signal (or the average of the feedback signal over a period of time). For example, the greater the difference between the predetermined value and the feedback signal, the greater the control signal is adjusted. In this way, the control circuit 16 may apply a coarse adjustment to the control signal to correct large errors in the output voltage of the module 14 while applying a fine adjustment to the control signal to correct small errors in the output voltage to reduce the amount of overshoot, ringing, and the like. In addition, at startup, the control circuit 16 is capable of controlling the module 14 to generate the predetermined voltage value, or near the predetermined voltage value, quickly without the requirement of a long warm-up time.

Figure 2:
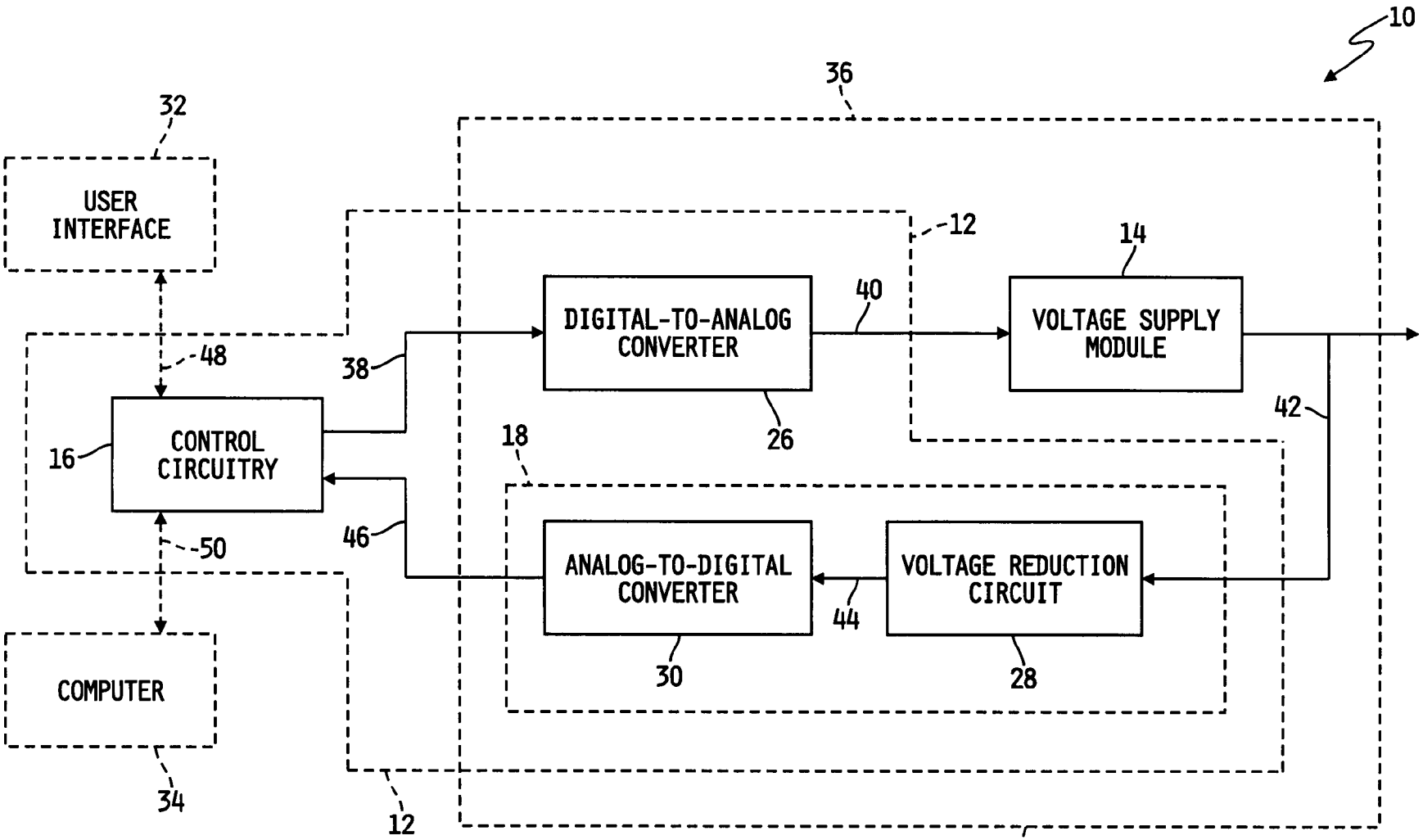
FIG. 2 is a simplified block diagram of another embodiment of a control system for controlling a power supply.

Referring now to FIG. 2, in a more specific embodiment, the power supply system 10 includes the control circuit 16, the digital-to-analog converter 26, the voltage supply module 14, and the feedback circuit 18. The feedback circuit 18 includes a voltage reduction circuit 28 and the analog-to-digital converter 30. In the embodiment illustrated in FIG. 2, the control circuit 16 does not include internal digital-to-analog or analog-to-digital converters. However, it should be appreciated that in other embodiments, one or both of the converters 26, 30 may be included internally in the control circuit 16 rather than as an external converter.

The data output terminals of the control circuit 16 are coupled to the input terminals of the converter 26 via a number of data signal paths 38 and the output terminal of the converter 26 is coupled to the input terminal of the voltage supply module 14 via a signal path 40. The input terminal of the voltage reduction circuit 28 is coupled to the output terminal of the voltage supply module 14 via a signal path 42 while the output terminal of the voltage reduction circuit 28 is coupled to the input terminal of the converter 30 via signal path 44. The output terminals of the converter 30 are coupled to the data input terminals of the control circuit 16 via a number of signal paths 46. In addition, the system 10 may include a user interface 32 coupled to the control circuit 16 via a signal path 48 and/or a computer 34 coupled to the control circuit 16 via a signal path 50. The signal paths 38, 40, 42, 44, 46, 48 and 50 may be any type of signal paths including, for example, wires, cables, printed circuit board traces, and the like. In addition, one or more of the signal paths 38, 40, 42, 44, 46, 48 and 50 may be a wireless connection and may use any type of communication technology and/or protocol to communicate data including, but not limited to, USB, TCP/IP, Bluetooth, ZigBee, Wi-Fi, Wireless USB, and the like. Further, it should be appreciated that signal paths 38, 46, 48, and 50 include any number of interconnects. For example, in one particular embodiment, the signal path 38 includes twenty data wires and the signal path 46 includes twenty-four data wires.

In operation, a predetermined voltage value is provided to the control circuit 16. The predetermined voltage value may be "hard-coded" into the firmware or software that is executed by the control circuit 16. Alternatively, the predetermined voltage value may be provided to the control circuit 16 via the user interface 32 and/or the computer 34. In addition, the predetermined voltage value may be adjusted over time according to the particular application in which the system 10 is used via the user interface 32 and/or the computer 34.

The control circuit 16 determines a digital control signal based on the predetermined value and transmits the control signal to the digital-to-analog converter 26 via the signal path 38. For example, the value of the digital control signal may be based on the value of the predetermined voltage value (i.e., the larger the predetermined voltage value, the larger the value of the digital control signal). The converter 26 converts the digital control signal to an analog control signal that is transmitted to the voltage supply module 14 via the signal path 40. In response to the analog control signal, the voltage supply module 14 generates an output voltage based on the voltage of the analog control signal (i.e., the output voltage is scaled according to the voltage of the analog control signal). The digital-to-analog converter 26 may be any type of digital-to-analog converter. However, it should be appreciated that the resolution of control of the analog control signal increases as the number of data inputs (i.e., input bits) of the converter 26 increases. In one particular embodiment, the converter 26 includes a data input of at least twenty bits. For example, a converter having twenty-four or more data inputs may be used.

The output voltage of the voltage supply module 14 is received by the voltage reduction circuit 28 via the signal path 42. The voltage reduction circuit 28 reduces the voltage of the output voltage to a value that is acceptable by the analog-to-digital converter 30 and the control circuit 16. In one particular embodiment, the voltage reduction circuit 28 reduces the output voltage of the module 14 to a voltage of about five volts or less. As discussed in more detail below in regard to FIG. 5, the voltage reduction circuit 28 may be configured according to the peak voltage of the output voltage of the module 14.

The output signal of the voltage reduction circuit 28 is transmitted to the analog-to-digital converter 30 via the signal path 44. The converter 30 converts the output signal to a digital feedback signal that is readable by the control circuit 16. The digital feedback signal generated by the converter 30 is transmitted to the control circuit 16 via the signal path 46. The converter 30 may be any type of converter capable of converting an analog signal to a digital signal. The converter 30 may be selected based on the data input terminals (i.e., the number of input bits) of the control circuit 16. That is, if the control circuit 16 includes a 24-bit data input, a converter having a 24-bit output may be selected. For example, in one particular embodiment, the converter 30 is an LTC 2400 24-bit analog-to-digital converter which is commercially available from Linear Technologies of Milpitas, Calif.

The control circuit 16 receives the digital feedback signal generated by the converter 30 and adjusts the control signal based on the digital feedback signal and the predetermined value. As discussed above, the control circuit 16 may use one or more of a number of control algorithms such as a simple linear control algorithm, a proportional-integral-derivative control algorithm, and/or a fuzzy logic control algorithms, and the like. In one particular embodiment, the control circuit 16 is configured to determine an average of the digital feedback signal received from the converter 30 over a period of time and adjust the control signal based on the average of the digital signal and the predetermined value. The control circuit 16 may scale the magnitude of the control signal according to the magnitude of the difference between the predetermined value and the digital feedback signal received from the converter 30 (or the average of the digital signal over a period of time) to achieve a coarse or a fine adjustment to the control signal as discussed above in regard to FIG. 1. The control circuit 16 may also display the predetermined voltage value and/or the measured output voltage of the module 14, as determined based on the digital feedback signal received from the converter 30, to a user of the system 10 via the user interface 32 and/or the computer 34.

Figure 3:
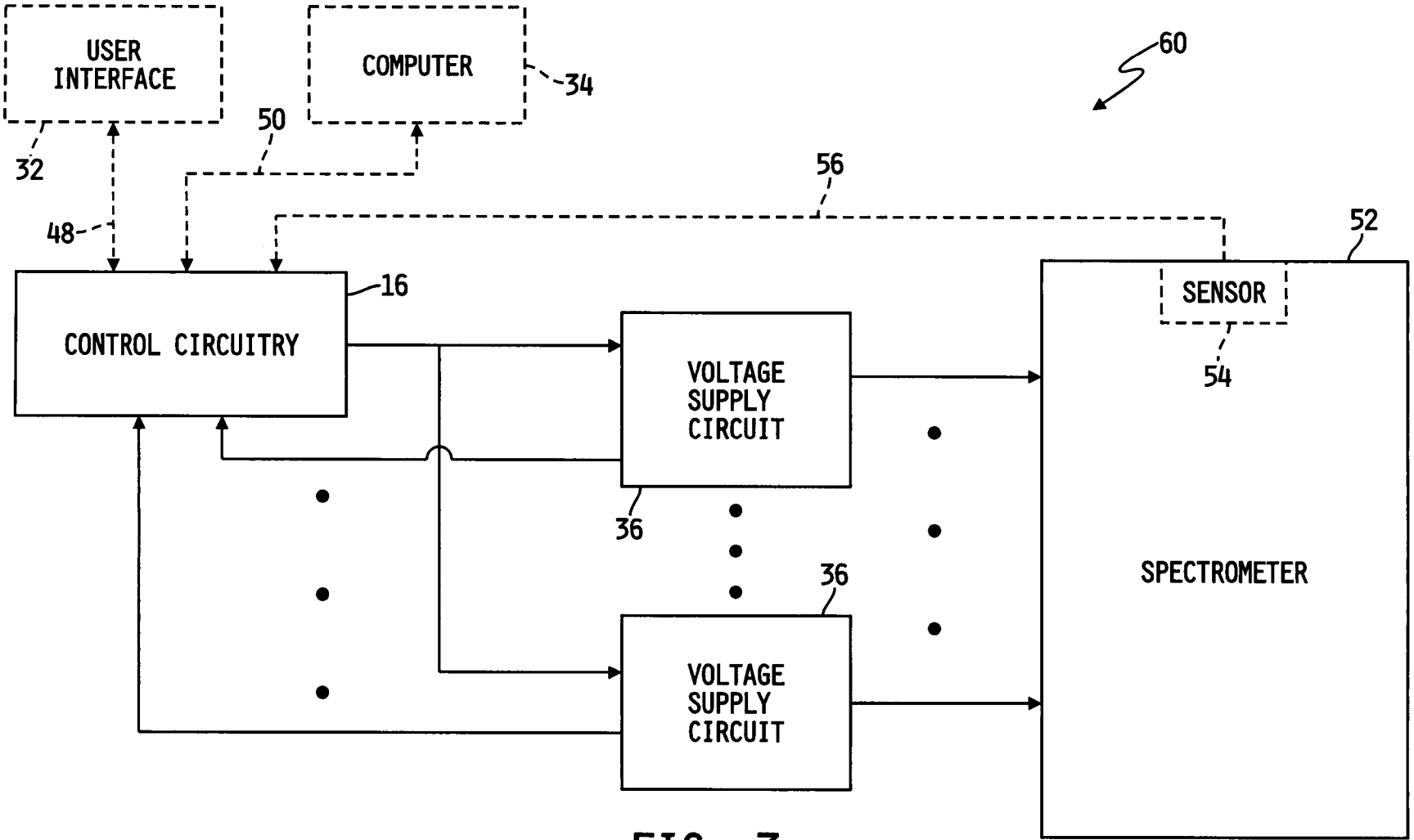
FIG. 3 is a simplified block diagram of a MALDI mass spectrometer system including a number of the control systems of FIG. 2.

The power supply system 10 may provide power to any type and number of devices. In particular, the system 10 may provide a number of separate and/or different high voltage power supplies. For example, as illustrated in FIG. 3, a power supply system 60 may be used to provide power to a spectrometer 52, such as a matrix assisted laser-desorption ionization (MALDI) mass spectrometer. Typical mass spectrometers require a number of different voltage supplies. As such, the system 60 includes a control circuit 16 coupled to a number of voltage supply circuits 36. Each voltage supply circuit 36 includes a digital-to-analog converter 26, a voltage supply module 14, a voltage reduction circuit 28, and an analog-to-digital converter 30 configured as shown in FIG. 2. The output control signal of the control circuit 16 is supplied to each of the voltage supply circuits 36 and the control circuit 16 receives a digital feedback signal from each of the circuits 36. In embodiments wherein different output voltage values are required for each voltage supply circuit 36, the system 60 may further include addressing circuitry (not shown) to facilitate selective communication between the control circuit 16 and any one of the circuits 36. Similarly, switching circuitry (not shown) may be used to multiplex the digital feedback signal received by the control circuit 16 from each of the circuits 36. The system 60 may further include a user interface 32 and/or a computer 34 coupled to the control circuit 16. The user interface 32 and/or computer 34 may be used to enter the predetermined values for each of the circuits 36. In this way, the control circuit 16 is capable of controlling the output voltage of each of the circuits 36 based on the digital feedback signal received from the respective circuit 36 and the associated predetermined voltage value for the respective circuit 36 using any one or more of the control algorithms discussed above in regard to FIGS. 1 and 2. The control circuit 16 may also be configured to display the predetermined voltage values and/or the measured output voltages of each of the voltage supply circuits 36 to a user of the system 60 via the user interface 32 and/or the computer 34.

In some embodiments, the MALDI mass spectrometer 52 may include one or more sensors 54. The sensor(s) 54 may be any type of sensor that is capable of determining and producing data signals indicative of an operational value(s) of the spectrometer 52 (e.g., laser-to-sample distance, resolution, etc.). The sensor(s) 54 is coupled to the control circuitry 16 via a signal path 56. Depending on the type and/or number of sensors 54 used, the signal path 56 may include any number of wires, cables, or other interconnects. The control circuitry 16 receives the operational data produced by the sensor(s) 54 via the signal path(s) 54. In response, the control circuitry 16 may be configured to adjust the control signal based on the operational data (and the predetermined value and the digital feedback signal as discussed above in regard to FIG. 2). For example, if a user of the spectrometer 52 adjusts the laser-to-sample distance, the control circuit may be configured to adjust, scale, or offset the control signal according to the change in the laser-to-sample distance.

Figure 4:
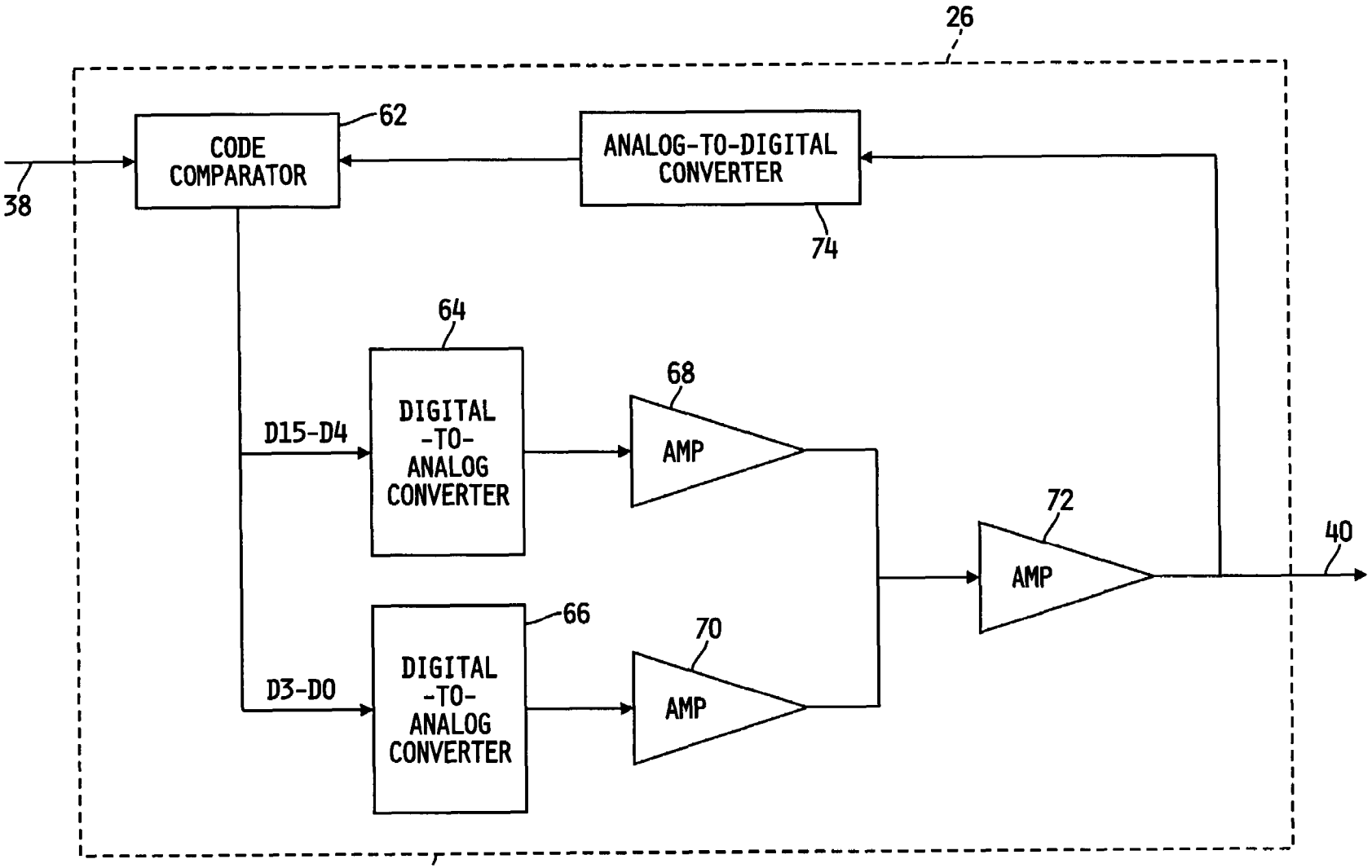
FIG. 4 is a simplified block diagram of one embodiment of an digital-to-analog converter circuit of the control system of FIG. 2.

As discussed above in regard to FIG. 2, the digital-to-analog converter 26 may have any number of data inputs. As the number of inputs of the converter 26 is increased, the resolution of control of the analog control signal supplied to (and the output voltage of) the module 14 is increased. The converter 26 may, therefore, be embodied as a single component or may, in some embodiments, be embodied as a number of separate components coupled together to increase the overall number of input bits of the converter 26. For example, in one embodiment as illustrated FIG. 4, the converter 26 includes a first digital-to-analog converter 64 and a second digital-to-analog converter 66. In the embodiment illustrated in FIG. 4, the converters 64, 66 are each sixteen bit converters, but converters having more or less input bits may be used. The converter 26 also includes a code comparator 62, a number of amplifiers 68, 70, and 72, and an analog-to-digital converter 74. The code comparator 62 receives the digital control signal from the control circuit 16 and a digital feedback signal from the converter 74. The code comparator 62 determines a data signal based on the digital control signal and the digital feedback signal and transmits the data signal to the converters 64, 66. Illustratively, the most significant sixteen bits of the data signal are supplied to the first converter 64 and the remaining four bits are supplied to the second converter 66. The remaining twelve data inputs of the second converter 66 are tied to low. In this way, the data signal from the comparator 62 is spread across the converters 64, 66. The converters 64, 66 convert the data signal received via their respective inputs into a corresponding analog signal that is amplified via amplifiers 68, 70, respectively. The amplified analog signals are summed at the input of the amplifier 72. The amplifier 72 generates an amplified analog signal corresponding to the digital data signal produced by the comparator 62. To improve the accuracy of the converter 26, the analog-to-digital converter 74 provides a digital feedback signal to the comparator 62. The converter 74 may be any type of analog-to-digital converter having a number of data outputs corresponding to the number of bits of the control signal generated by the control circuit 16 and received by the code comparator 62. The code comparator 62 determines a difference value between the control signal received from the control circuit 16 and the digital feedback signal received from the converter 74 and adjusts the data signal based on the difference value. In this way, a twenty-four bit digital-to-analog converter may be constructed using two sixteen bit digital-to-analog converters and other components. In should be appreciated, however, that additional components may be included in the circuitry of the converter 26. Further, the circuitry of the converter 26 illustrated in FIG. 4 may be modified based on the particular application of the power supply system 10, 60.

Figure 5:
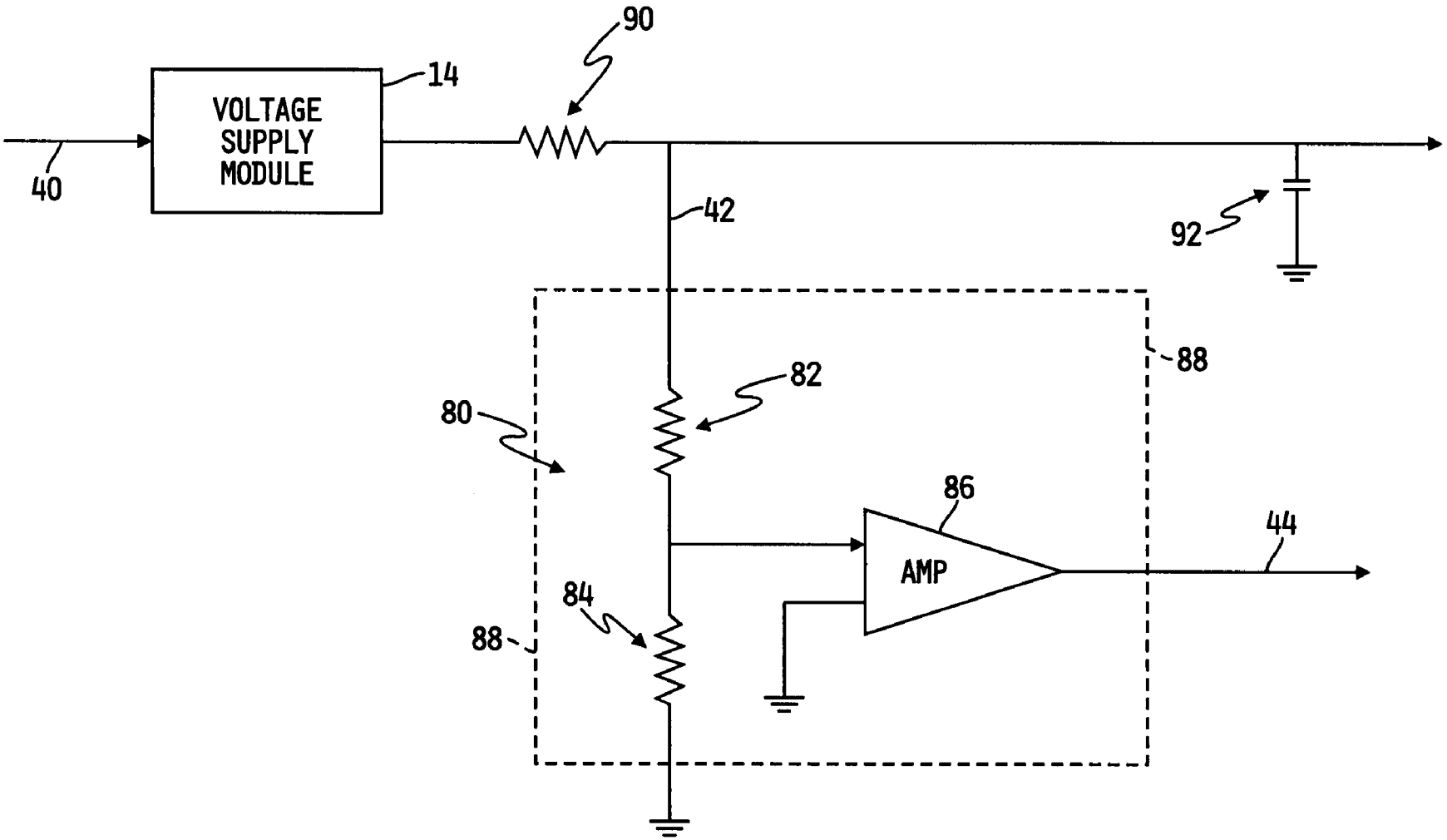
FIG. 5 is a simplified block diagram of a voltage reduction circuit of the control system of FIG. 2.

Referring now to FIG. 5, in one embodiment, the voltage reducing circuit 28 may be embodied as a voltage divider. More particularly, the circuit 28 may be embodied as a high impedance resistive divider 80 having a first resistor 82 and a second resistor 84. The values of the individual resistors 82, 84 are selected according to the voltage output of the power supply module 14. For example, if the voltage output of the module 14 is about 30,000 volts, the resistors 82, 84 may be selected to have a ratio of about 10,000:1 so as to produce a peak voltage of about three volts. In addition, the resistors 82, 84 may be selected to be high impedance resistors to reduce the thermal buildup of the resistors due to current flow therethrough. For example, the resistors 82, 84 may be selected so that at the maximum voltage output of the module 14, the current through the resistors 82, 84 is not greater than about one micro-Amp. In one particular embodiment, the resistor 82 is a 100 giga-ohm resistor and the resistor 84 is a 100 mega-ohm resistor. Regardless, the reduced voltage output of the resistive divider 80 is received by an amplifier 86. The amplifier 86 amplifies the reduced voltage output to a maximum voltage acceptable by the analog-to-digital converter 30 to improve the resolution of control of the system 12. The gain of the amplifier 86 may be configured based on the maximum voltage of the reduced voltage output and the maximum allowed voltage of the input of the converter 30. For example, if the converter 30 is capable of accepting a five volt input and the resistive divider 80 produces a reduced voltage output having a maximum voltage of three volts, the gain of the amplifier 86 may be set to about 1.67.

The accuracy of the overall control system 12 is dependent on the accuracy of the individual components which form the system 12. To improve the accuracy of system 12, the converters 26 and 30 may be chosen from a selection of high accuracy converters. However, because the voltage reduction circuit 28 is an analog circuit, the accuracy of the circuit 28 (and, therefore, the system 12) is susceptible environmental effects which may reduce the accuracy of the circuit 28 by causing voltage drift and/or other signal errors. As used herein, the term "environmental effects" includes such error-causing effects as electrical noise (e.g., electromagnetic interference (EMI), electrostatic discharge (ESD), etc.) that may be produced by, for example, the voltage supply module 14 and/or other electrical components in the vicinity of the control system 12 and temperature variations resulting from heat generated by the operation of the voltage supply module 14, heat generated by any other source in the vicinity of the control system 12, and/or cooling effects resulting from ambient cooling systems and/or other cooling systems in the vicinity of the control system 12. The accuracy of the circuit 28 may be improved by selecting resistors 82, 84 that have very high impedance values as discussed above. In addition or alternatively, the accuracy of the circuit 28 may be improved by selecting resistors 82, 84 that are designed to be immune, substantially immune, or otherwise resistant to the environmental effects of noise and/or temperature (i.e., resistors having low noise and/or low temperature drift). Further, the accuracy of the voltage reduction circuit 28 may be improved by positioning the circuit 28 within an isolation shield 88. The isolation shield 88 may be any type of shield, chamber, barrier, or similar device capable of substantially isolating the circuit 28 from one or more sources of environmental effects. As such, the isolation shield 88 may completely or partially surround the voltage reduction circuit 28. For example, the isolation shield 88 may be or include an electrostatic shield, such as a Faraday cage, configured to substantially isolate the voltage reduction circuit 28 from external noise-causing sources such as electromagnetic interferences, electrostatic discharge, and the like. Alternatively or additionally, the isolation shield 88 may be or include a thermal-controlled chamber configured to substantially isolate the voltage reduction circuit 28 from external thermal sources which may cause drift or other errors in the reduced voltage output signal of the circuit 28. For example, the chamber 28 may be wrapped in an isolative material. Additionally, the voltage reduction circuit 28 may be located in a position away from other components of the system 12 and/or the power supply system 10 to reduce any noise received by such components.

Other components and circuitry may be included in the control system 12 to reduce the effects of noise, temperature, and other error-causing sources in the voltage reduction circuit 28. For example, as illustrated in FIG. 5, a resistor 90 and a capacitor 92 are included on the output of the voltage supply module 14. The resistor 90 and capacitor 92 form an RC circuit configured to filter AC noise from the input to the voltage reduction circuit 28. However, other AC filter circuits may be used such as RL filters, RLC filters, or RC filters based on the AC filtering characteristic and/or performance desired.

Figure 6:
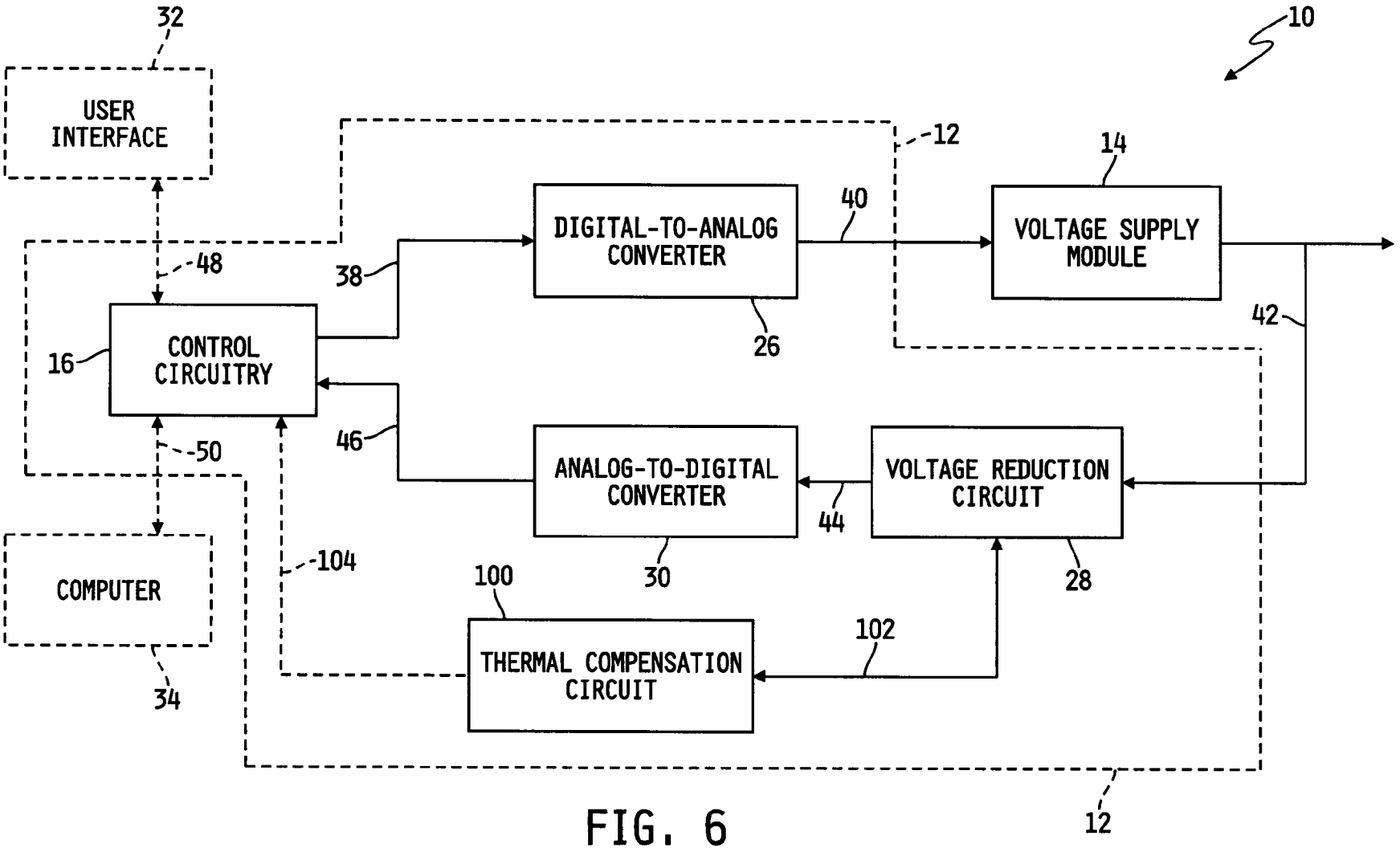
FIG. 6 is a simplified block diagram of another embodiment of the control system of FIG. 2 having a thermal compensation circuit included therewith.

In addition, referring now to FIG. 6, the system 12 may include a thermal-compensating system 100 operatively coupled to the voltage reduction circuit 28 and configured to monitor and control the temperature of the circuit 28. For example, the thermal-compensating system 100 may receive temperature data regarding the temperature of the circuit 28 via signal paths 102. The temperature data may be produced by, for example, thermocouples (not shown) coupled to one or both of the resistors 82, 84 (see FIG. 5). In response to the temperature data, the system 100 may be configured to compensate the circuit 28 based on the temperature data. To do so, in one embodiment, the system 100 is configured to compensate the voltage value of the output signal produced by the circuit 28. For example, the system 100 may be configured to increase or decrease the voltage of the output signal of circuit 28 depending on the measured temperature of the circuit 28 as determined from the temperature signal. Additionally or alternatively, the system 100 may cool or heat the voltage reduction circuit 28 (e.g., cool or heat the resistors 82, 84) to maintain the temperature of the circuit 28 (e.g., resistors 82, 84) at a predetermined temperature value. Still further, in some embodiments, the system 100 may transmit compensating data (e.g., temperature data, compensation voltage data, etc.) to the control circuitry 12. In response, the control circuit 12 may further adjust the control signal based on the feedback signal, the predetermined voltage, and the compensating data. Regardless, it should be appreciated that by isolating or otherwise reducing the effect of noise, temperature, and the like on the output of the voltage reduction circuit 28, the overall accuracy of the control system 12 may be improved.

Although the power supply system 10 and the control system 12 have been described herein as applicable to power supplies for mass spectrometers, it should be appreciated that the power supply system or system 12 may be applicable to other devices and applications. For example, the control system 12 may be used in any application wherein control of a voltage source, such as a high voltage source, is desired. In particular, the system 12 may be used in devices wherein the impedance of the load of the device changes during the operation of the device such as plasma generating devices used in semiconductor manufacturing or the like. Such impedance changes may cause an adverse drop or change in the voltage supply of the device and cause resulting errors. By use of the power supply system 10 or the system 12, the voltage of the device may be monitored and adjusted to compensate for the change in impedance of the load.

It will be noted that alternative embodiments of the control system, control circuit, and power supply system of the present disclosure may not include all of the features described yet still benefit from at least some of such features. Those of ordinary skill in the art may readily devise their own implementations of the control system, control circuit, and power supply system that incorporate one or more of the features of the present invention and fall within the spirit and scope of the present disclosure as defined by the appended claims.

The invention claimed is:

1. A control system for a power supply, the control system comprising:

a feedback circuit including a high impedance voltage reduction circuit configured to receive an output voltage from the power supply and produce a voltage reduction signal having a voltage less than the output voltage, the high impedance voltage reduction circuit isolating the voltage reduction signal from environmental effects in the vicinity of the control system; and a control circuit configured to receive the voltage reduction signal and produce a control signal based on the voltage reduction signal and a predetermined voltage value, the control circuit controlling the power supply via the control signal to maintain the output voltage at about the predetermined voltage value.

2. The control system of claim 1, wherein the high impedance voltage reduction circuit is substantially thermally isolated.

3. The control system of claim 1, wherein the high impedance voltage reduction circuit is substantially isolated from electrical noise.

4. The control system of claim 1, wherein the high impedance voltage reduction circuit is positioned within an isolation shield.

5. The control system of claim 4, wherein the isolation shield includes an electrostatic shield.

6. The control system of claim 4, wherein the isolation shield includes a thermal-controlled chamber.

7. The control system of claim 1, further comprising a temperature compensating system coupled to the high impedance voltage reduction circuit and configured to control the temperature of the high impedance voltage reduction circuit to maintain the temperature at about a predetermined temperature value.

8. The control system of claim 1, wherein the high impedance voltage reduction circuit has an impedance of at least about 100 giga-ohms.

9. The control system of claim 1, wherein the high impedance voltage reduction circuit includes a voltage divider circuit.

10. The control system of claim 9, wherein the voltage divider circuit includes a resistive divider circuit.

11. The control system of claim 10, wherein the resistive divider circuit has an impedance of at least about 100 giga-ohms.

12. The control system of claim 1, wherein the feedback circuit further includes a converter configured to convert an output signal of the voltage reduction circuit to a digital signal.

13. The control system of claim 1, wherein the voltage reduction signal has a voltage of no greater than about five volts.

14. The control system of claim 1, wherein the output voltage is greater than about 1,000 volts.

15. The control system of claim 14, wherein the output voltage is about 30,000 volts.

16. The control system of claim 1, wherein the control circuit is configured to produce the control signal based on the voltage reduction signal and the predetermined voltage value using at least one of a proportional-integral-derivative algorithm, fuzzy logic algorithm, and an averaging algorithm.

17. The control system of claim 1, wherein the control circuit is configured to determine an average value based on the voltage reduction signal and produce the control signal based on the average value and the predetermined voltage value.

18. The control system of claim 1, wherein the control circuit is configured to determine a difference value between the voltage reduction signal and the predetermined voltage value and scale the control signal based on the difference value.

19. The control system of claim 1, further comprising a user interface coupled to the control circuit, the user interface operable to provide the predetermined voltage value to the control circuit.

20. The control system of claim 19, wherein the user interface is configured to display the output voltage.

21. The control system of claim 1, further comprising a converter configured to receive the control signal and produce an analog control signal based thereon, wherein the power supply is configured to generate the output voltage based on the analog control signal.

22. The control system of claim 21, wherein the converter includes a digital-to-analog converter having an input of at least twenty bits.

23. A method of controlling a high voltage power supply configured to produce an output voltage in response to a control signal, the method comprising:

producing a voltage reduction signal, based on the output voltage, with a voltage reduction circuit, the voltage reduction signal having a voltage less than the output voltage;

isolating the voltage reduction signal from environmental effects in the vicinity of the voltage reduction circuit;

determining the control signal based on the voltage reduction signal and a predetermined voltage value; and maintaining the voltage output voltage at about the predetermined voltage value via the control signal.

24. The method of claim 23, wherein the isolating step includes shielding the voltage reduction circuit from environmental effects.

25. The method of claim 24, wherein the shielding step includes shielding the voltage reduction circuit from electrical noises.

26. The method of claim 24, wherein the shielding step includes substantially thermally isolating the voltage reduction circuit.

27. The method of claim 23, wherein the output voltage is about 30,000 volts.

28. A MALDI mass spectrometer system comprising:

a MALDI mass spectrometer having a power input for receiving a power supply voltage;

a power supply configured to produce the power supply voltage in response to a control signal;

a feedback circuit configured to receive the power supply voltage from the power supply and produce a voltage reduction signal having a voltage less than the power supply voltage; and a control circuit configured to receive the voltage reduction signal and produce the control signal based on the voltage reduction signal and a predetermined voltage value, the control circuit controlling the power supply via the control signal to maintain the power supply voltage at about the predetermined voltage value.

29. The MALDI mass spectrometer system of claim 28, wherein the MALDI mass spectrometer includes at least one sensor configured to produce operational data related to the operation of the MALDI mass spectrometer and the control circuit is configured to receive the operational data and produce the control signal based on the operational data, the voltage reduction signal, and the predetermined voltage value.

30. A control circuit for controlling a power supply, the control circuit comprising:

a feedback circuit configured to receive an output voltage from the power supply and produce a feedback signal indicative of the output voltage, at least a portion of the feedback circuit being positioned in an isolation shield; and a control circuit configured to receive the feedback signal and control the power supply to generate the output voltage based on the feedback signal and a predetermined voltage value.

* * * * *